US005584242A

United States Patent [19]

Fuller et al.

[11] Patent Number: 5,584,242

[45] Date of Patent: Dec. 17, 1996

[54] CLAMP ASSEMBLY FOR LITHOGRAPHIC PLATES

[75] Inventors: Douglas D. Fuller, Contoocook, N.H.; Lawrence Carme, Winchester, Mass.; Edwin G. Theriault, Hudson, N.H.

[73] Assignee: Presstek, Inc., Hudson, N.H.

[21] Appl. No.: 433,840

[22] Filed: May 4, 1995

[51] Int. Cl.[6] ..... B41F 27/12

[52] U.S. Cl. ..... 101/415.1; 101/DIG. 36

[58] Field of Search ..... 101/378, 415.1, 101/481, DIG. 36

[56] References Cited

U.S. PATENT DOCUMENTS

| | | | |
|---|---|---|---|
| 2,386,214 | 10/1945 | Harrold et al. | 101/415.1 |
| 2,844,123 | 7/1958 | Hayford | 101/425 |
| 3,217,644 | 11/1965 | Schmidt | 101/415.1 |
| 3,735,702 | 5/1973 | Kossak | 101/425 |
| 3,781,107 | 12/1973 | Ruhland | 15/256.53 |
| 4,953,252 | 9/1990 | Akisawa | 101/425 |
| 5,086,701 | 2/1992 | Gasparrini et al. | 101/423 |
| 5,123,354 | 6/1992 | Loos | 101/425 |
| 5,325,778 | 7/1994 | Hartung et al. | 101/415.1 |

FOREIGN PATENT DOCUMENTS

| | | | |
|---|---|---|---|
| 246012 | 11/1987 | European Pat. Off. | 101/415.1 |
| 2474899 | 8/1981 | France | 15/256.53 |
| 2016847 | 12/1971 | Germany | 101/415.1 |
| 3319246 | 12/1984 | Germany | 101/415.1 |
| 3401351 | 7/1985 | Germany | 101/415.1 |
| 562687 | 6/1975 | Switzerland | 101/425 |

*Primary Examiner*—Stephen R. Funk
*Attorney, Agent, or Firm*—Cesari and McKenna

[57] ABSTRACT

A clamp assembly for clamping a lithographic plate to a cylinder includes a base defining a channel and a plate mounted to the base and overlying the channel. An elongated cam member is rotatably positioned in the channel, the member having a cam surface profiled so that when the cam member is in a first angular position, that surface extends relatively close to the plate and when the cam member is in a second position, that surface is further away from the plate. Stops are included for establishing the two positions of the cam member. When the cam member is in its second position and an edge margin of a recording medium is inserted between the cam member and the plate, moving the cam member to its first position causes the clamp assembly to simultaneously grip and pull on the recording medium. An interposer may be positioned between the plate and the cam member to prevent direct engagement of the recording medium by the cam member and thus prevent the clamp assembly from pulling on the recording medium while clamping the medium.

14 Claims, 3 Drawing Sheets

CLAMP ASSEMBLY FOR LITHOGRAPHIC PLATES

This invention relates to lithography apparatus. It relates more particularly to a clamp assembly for mounting a lithographic plate to a plate cylinder.

BACKGROUND OF THE INVENTION

In offset lithography, an image is present on a plate as a pattern of ink-accepting and ink-repellent surface areas. In a typical sheet-fed offset press system, the plate is mounted to a plate cylinder, is inked and makes contact with the compliant surface of a blanket cylinder which, in turn, applies the image to paper sheets pinned to an impression cylinder, which brings the sheets into contact with the blanket cylinder.

Traditionally, the plates for an offset press have usually been produced photographically. More recently, however, a number of electronic alternatives have been developed some of which can be used on-press. With such systems, digitally controlled imaging devices alter the ink-receptivity of a plate blank mounted to a plate cylinder in a pattern representative of the image to be printed. Such imaging devices include lasers that cause chemical changes on the plate blank, ink jets that directly deposit ink-repellent or ink-accepting spots on the plate blank and spark or ion discharge devices which physically alter the topology of the plate blank. These various methods of imaging lithographic plates are described in detail in U.S. Pat. Nos. 3,506,779; 4,054,094; 4,347,785; 4,911,075 and 5,385,092, among others.

Another approach to imaging lithographic plates described, for example, in U.S. Pat. Nos. 3,945,318; 3,962,513 and 4,395,946 involves the use of thermal-transfer materials. In these systems, a plastic acceptor sheet or plate is mounted to a cylinder and a so-called donor sheet, coated with a transferable material, is wrapped around the acceptor sheet with the transferable material facing the acceptor sheet. To create an image, the cylinder is rotated and a digitally controlled laser scans the donor/acceptor sheet set so that the transfer material is selectively irradiated through the donor sheet. The irradiation causes the transfer material to adhere preferentially to the acceptor sheet. The transfer material and acceptor sheet material have different affinities for ink so that when the donor sheet is removed from the cylinder, the acceptor sheet is left with an image pattern on its outer surface.

The donor sheet could also be a so-called strip sheet which is coated with a layer of an adhesive and laid over an ink-receptive acceptor sheet or plate coated with an ink-repellent material such as silicone. In this case, imaging may be accomplished by projecting laser energy through the strip sheet onto the plate. When the strip sheet is removed, the adhesive will pull the imaged silicone areas away from the plate, while leaving the remaining silicone attached to the plate thus forming the image.

When mounting an imaged plate to a plate cylinder for a press run or when mounting a plate blank to a cylinder for imaging or platemaking, it is essential that the plate be wrapped tightly around the cylinder and that the head and tail end of the plate be secured firmly to the cylinder so that when the cylinder is rotated, there will be no relative movement between the plate and the cylinder.

Likewise, when a donor/acceptor sheet set is mounted to a cylinder for platemaking by thermal transfer, both sheets must be firmly clamped to the plate to avoid all relative movement.

Various devices have been developed over the years for holding a lithographic plate to a plate cylinder. These devices have run the gamut from vacuum clamps to assorted mechanical and electromechanical clamps. For the most part, they have all tended to be relatively complex and costly. Also, in many cases, different clamping mechanisms are required to secure the head and tail ends of the plate to the cylinder. In addition, some prior clamping devices have to be repositioned on the cylinder in order to secure different length plates to the cylinder.

Accordingly, it would be advantageous if there did exist a mechanism for mounting a lithographic plate or donor/acceptor sheet set to a cylinder which would avoid the above problems.

SUMMARY OF THE INVENTION

The present invention enables rapid, efficient mounting of a recording member such as a lithographic plate to a cylinder for printing. It is equally advantageous for mounting a plate blank or a donor/acceptor sheet set to a cylinder for platemaking.

The advantages are achieved by employing in a rotary cylinder, a head clamp for registering and clamping the leading edge margin of a recording medium to the cylinder and a tail clamp for clamping the trailing edge margin of the medium to the cylinder while at the same time, tensioning the medium about the cylinder. The clamps are mounted to the cylinder close to each other and substantially parallel to the cylinder axis.

Each clamp includes a base defining a channel which extends substantially the entire length of the cylinder and a plate which overlies the channel. An elongated cam member is rotatably positioned in the channel of each clamp and each cam member has a cam surface spaced from the corresponding plate to define a gap for receiving an edge margin of the recording medium.

Each cam member is movable between a clamping position wherein the operative cam surface is spaced relatively close to the corresponding plate and an open or unclamping position wherein the operative cam surface is spaced further away from the corresponding plate. Means are provided for establishing the two positions of each cam member so that when each cam member is in its open position and an edge margin of the recording medium is inserted into the gap of the associated clamp, moving that cam member to the clamping position normally causes the cam member to simultaneously grip and draw the recording medium into the channel of that clamp to some extent.

However, the head clamp may also include recording medium registration pins extending from the head clamp plate and disposed along a line substantially parallel to the head clamp cam member and an interposer positioned between the cam member and plate of the head clamp which prevents that cam member from directly contacting the recording medium edge margin in the gap of the head clamp when that cam member is moved to its clamping position. The interposer thus negates the pulling action of the head clamp and facilitates registration of the leading edge of the recording medium against the head clamp registration pins.

Thus essentially the same clamping mechanisms may be used as the head and tail clamps for recording media such as lithographic plates and donor/acceptor sheet sets. Furthermore, as we shall see, in some cases, different length plates may be mounted to a cylinder without having to reposition the clamps on the cylinder.

With all of the above advantages, the present clamp assembly is relatively easy and inexpensive to make and to assemble. Therefore, it should find wide application in the printing industry.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
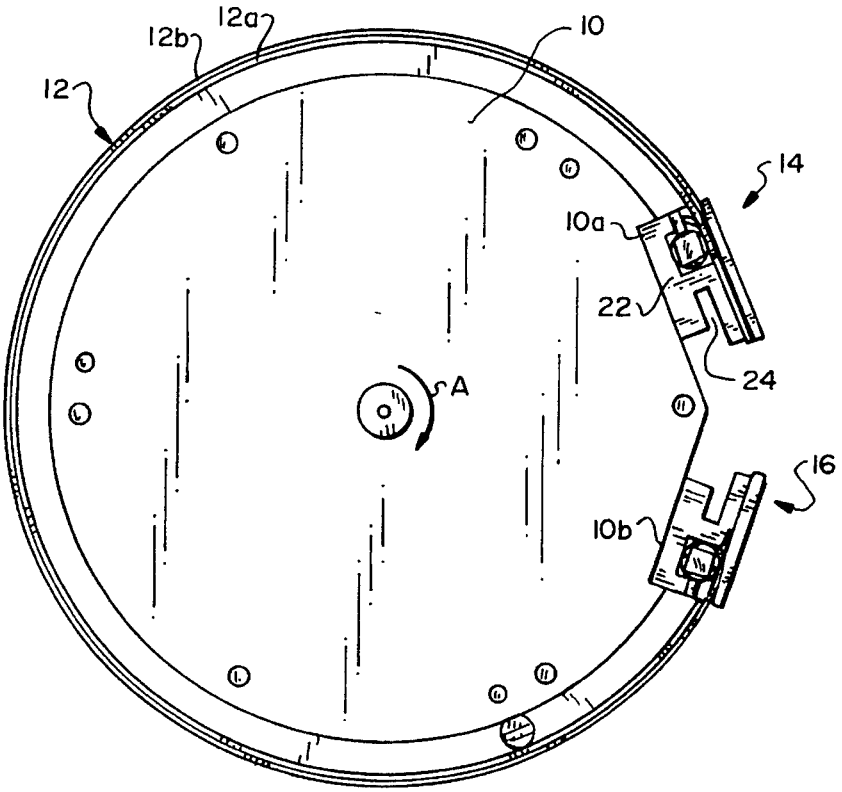
FIG. 1 is a view in end elevation of a rotary cylinder fitted with head and tail clamp assemblies embodying the invention.

Refer to FIG. 1 of the drawings which illustrates a rotary cylinder or drum 10 which may be supported for rotation in the direction of the arrow A. Cylinder 10 may be the plate cylinder of a lithographic press or it may be mounted for rotation off press, in platemaking apparatus for example.

Wrapped around cylinder 10 is a recording medium shown generally at 12. The medium 12 specifically illustrated in FIG. 1 is a donor/acceptor sheet set of the type described above consisting of an inner acceptor sheet **12*a* and an outer donor sheet 12*b*. Of course, medium 12 could just as well be a single lithographic plate. In any event, the leading end or edge margin of medium 12 is clamped to the cylinder 10 by a head clamp assembly shown generally at 14. The trailing end or edge margin of the medium is secured to the cylinder by a tail clamp assembly shown generally at 16 which grips medium 12 and also stretches it around the circumference of cylinder 10. As will be seen, the head and tail clamp assemblies 14 and 16 are, for the most part, substantially the same, but they function somewhat differently. As shown in FIG. 1, the clamp assemblies are located in notches 10*a* and 10*b***, respectively, formed in the cylinder surface and face one another at an included angle of about 120°.

Figure 2:
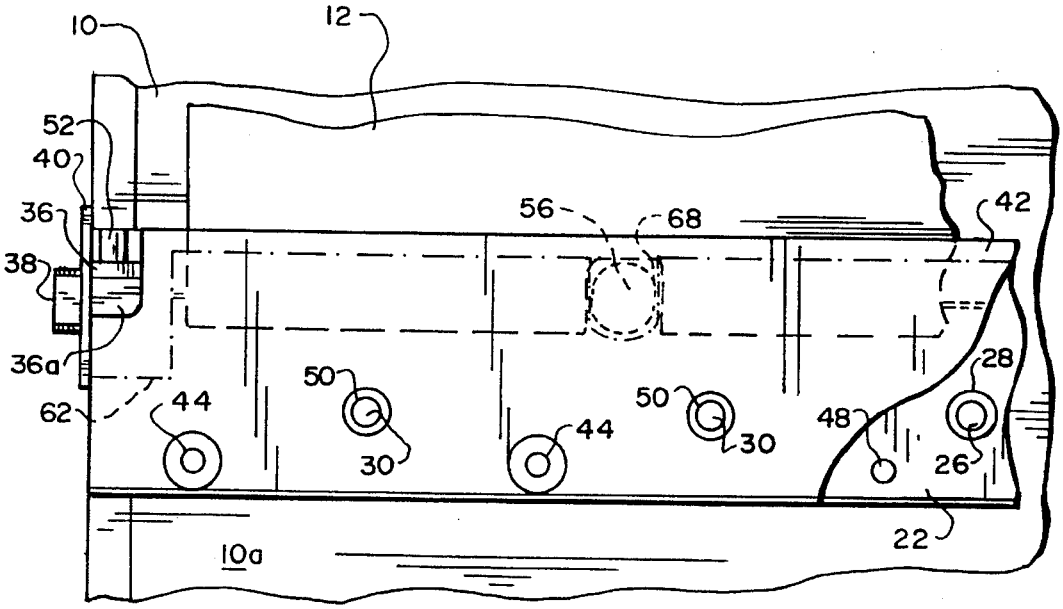
FIG. 2 is a fragmentary plan view on a larger scale showing the head clamp assembly in FIG. 1.
Figure 3:
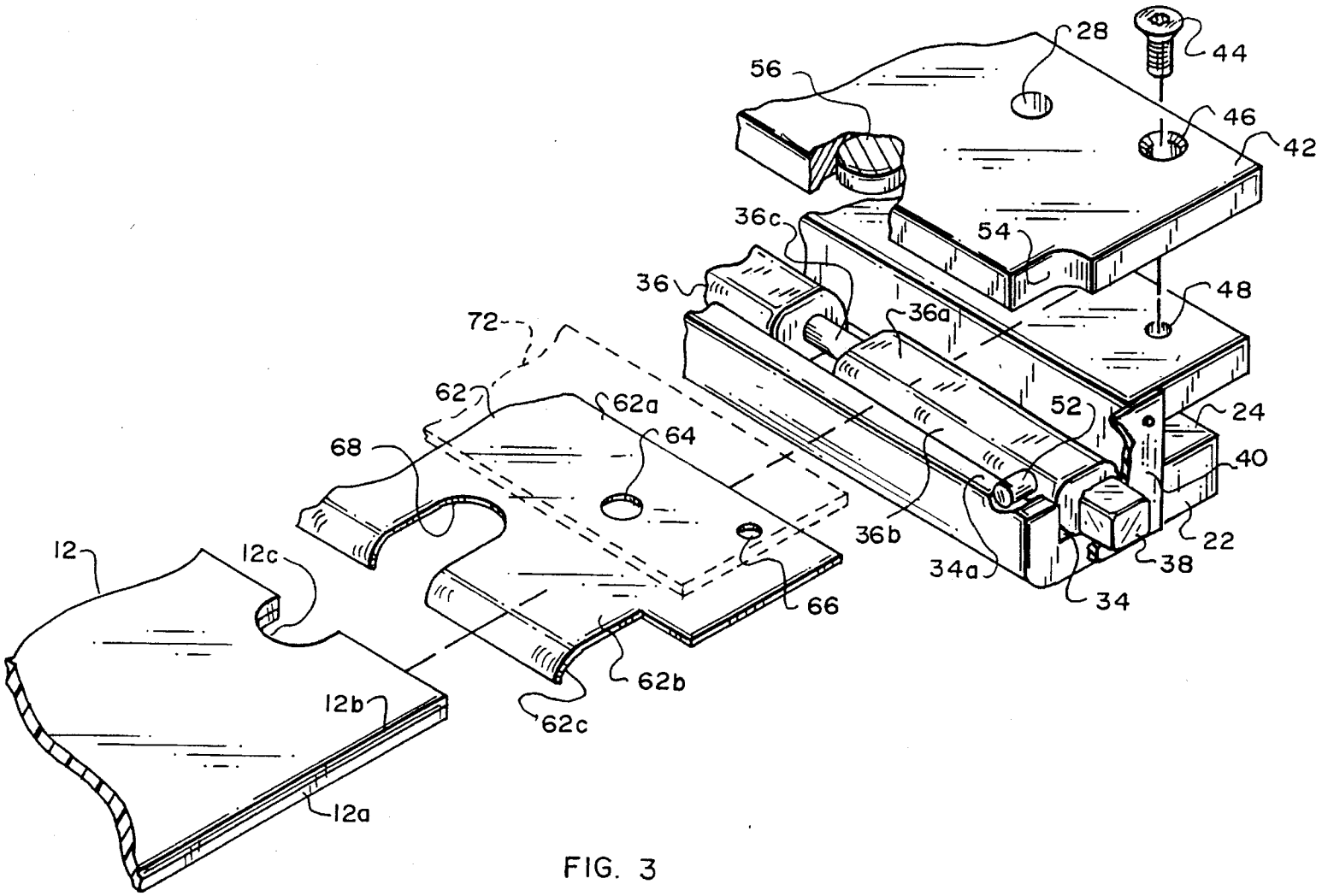
FIG. 3 is a fragmentary exploded perspective view showing the elements of the head clamp assembly in greater detail, with the assembly being in its open or unclamping position.

Referring now to FIGS. 2 and 3, the head clamp assembly 14 comprises an elongated block or base 22 which seats in the cylinder notch **10*a* and extends the length of the cylinder 10. For reasons that will be described later, portions of the block may be of a compliant or resilient material. A lateral slot 24 is formed in the side of block 22 that faces clamp assembly 16 and the portion of block 22 below slot 24 is somewhat narrower than the portion of the block above the slot. A lengthwise series of threaded screw holes 26 is present in the portion of block 22 below slot 24 adjacent to the inner end of the slot. One of these screw holes 26 is illustrated at the right hand end of FIG. 2. A similar series of larger access holes 28 are formed in the block portion above slot 24 which holes 28 are in register with holes 26. Thus, block 22 may be secured to cylinder 10 by threaded fasteners 30 inserted via access holes 28 into holes 26 and threaded into corresponding holes (not shown) in cylinder 10**.

Formed on the opposite side of block 22 from slot 24 is a trough or channel 34 which extends the length of the block. Rotatably seated in channel 34 is an elongated rigid cam member 36 having a cam surface which is profiled to provide a flat area or sector **36*a* extending along a side of the cam member and a rounded rising camming area along the remainder of the member which reaches a maximum height at an area or sector 36*b* located about 90° around the cam member from the flat sector 36*a***.

Figure 4:
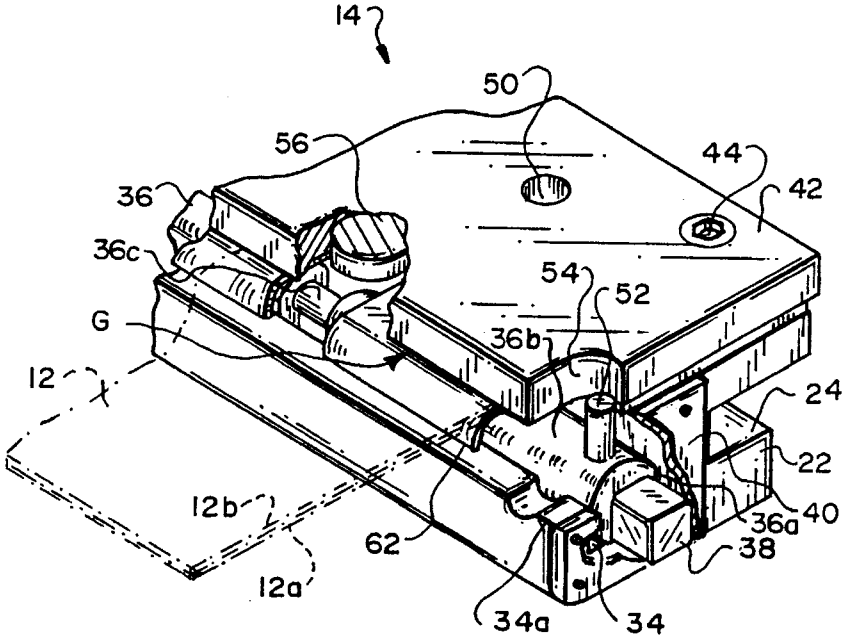
FIG. 4 is a fragmentary perspective view of the head clamping assembly in its clamping position.

The cam member 36 is shaped and arranged so that it can be rotated in channel 34 between an open or unclamping position shown in FIG. 3 in which the flat sector **36*a* faces toward the mouth of the channel 34 and a clamping position illustrated in FIG. 4 in which the raised surface area 36*b* faces in that direction. Preferably, keys 38 project from the ends of cam member 36 to facilitate rotating the cam member between its two operative positions. Preferably also, the outer wall 34*a* of channel 34 is shortened to expose cam member 36 for reasons that will become apparent. The cam member 36 may be retained in the channel 34 by end plates 40 secured to the opposite ends of block 22 such that the keys 38** project through the end plates.

Thus, the cam member 36 simply sits in channel 34 and requires no rotary bearings.

A relatively thick, semi-rigid top plate 42 which is substantially co-extensive with the upper portion of block 22 is positioned on block 22 so as to define a gap G (FIGS. 4 and 5) between the plate and the cam member 36. Plate 42 may be removably secured to the block by screws 44 extending down through a lengthwise series of countersunk holes 46 in the top plate and turned down into registering threaded holes 48 in the upper portion of block 22. Top plate 42 also has a lengthwise series of screw access holes 50 which are in register with the access holes 28 in block 22 so that clamp assembly 14 may be secured to cylinder 10 by threaded fasteners 30 without having to remove plate 42 from block 22.

As mentioned above, the cam member 36 is movable between two operative positions. To establish these positions, a stop pin 52 extends out radially from cam member 36 at one or both ends of the cam member. The pin(s) is positioned on the cam member such that it engages the top edge of the channel outer wall **34*a* when the cam member 36 is in its open position such that the cam flat sector 36*a* faces plate 42 and gap G is relatively large. On the other hand, when the cam member is turned clockwise as viewed in FIGS. 3 and 4 so that the pin 52 engages against the wall of a notch 54 provided in the top plate 42, the cam member is in its clamping position in which the raised camming surface area 36*b* faces plate 42** so that gap G is smaller.

As best seen in FIGS. 2 and 3, the top plate 42 of clamp assembly 14 is provided with recording medium registration or locating pins 56 which extend from the plate toward block 22 and are disposed along a line just behind cam member 36. The illustrated assembly 14 has two such registration pins 56 spaced from the opposite ends of the plate. To provide clearance for these pins, the cam member 36 may have reduced diameter segments **36*c* opposite the pins so that the registration pins 56** do not interfere with the movements of the cam member between its two operative positions.

In accordance with the invention, the head clamp assembly 14 also includes an interposer 62 which is positioned between block 22 and top plate 42 before securing the top plate to the block. The interposer is basically a thin flat plate in the nature of a leaf spring. It has a generally rectangular base portion 62*a* which is coextensive with the top surface of block 22 and a somewhat narrower rectangular working portion 62*b* which, when the interposer is installed, is cantilevered opposite cam member 36 as best seen in FIG. 4. The free longitudinal edge margin of that portion is bent to form a lip 62*c* which curves around cam member 36 to some extent.

A lengthwise series of holes 64 in the interposer portion 62*a* register with the access holes 28 and 50 in block 22 and top plate 42, respectively. Also present in the interposer base portion is a line of holes 66 near the edge of that portion which provide clearance for the screws 44 that secure the top plate 42 to block 22. Finally, slots 68 are provided in the forward edge of interposer portion 62*b*, including the lip 62*c*, to provide clearance for the locating pins 56 extending from the top plate 42. Since there are two locating pins in the present apparatus, two such slots 68 are provided in the interposer spaced from the opposite ends thereof.

Thus, the interposer portion 62*b* fills part of the gap G between the cam member 36 and the top plate 42 of the head clamp assembly 14 and, as we shall see presently, prevents the cam member 36 from directly contacting a recording medium positioned in gap G.

There may also be a spacer 72 located between plate 42 and the interposer portion 62*a* as shown in phantom in FIG. 3. This will ensure that a sufficient gap or space exists between the plate and the interposer to accomodate the full thickness of the recording medium 12.

Also, to accomodate some variation in the thickness of medium 12, plate 42 and/or block 22 on at least the portion thereof below cam member 26, may be of a somewhat compliant material. This will allow some control over the clamping force exerted on the medium 12.

To use the clamp assembly 14, the key 38 is turned so as to position the cam member 36 in its open or unclamping position illustrated in FIG. 3 wherein the cam member flat sector 36*a* faces top plate 42. Then, the leading edge margin of the recording medium 12 is slid into the space between the top plate 42 and the interposer 62, which space is large enough to accept the thickness of the recording medium. Particularly if the spacer 72 is present. The curved interposer lip 62*c* facilitates this insertion. The flat area 36*a* of the cam member allows the interposer portion 62*b* to flex downwardly sufficiently to enable the recording medium to be slid into place under the top plate 42, so that its leading edge can abut the registration pins 56 to assure that the medium is squared up on cylinder 10. If the medium consists of a plural sheet set, obviously the leading edges of all of the sheets should be in register.

As shown in FIG. 3, notches 12*c* may be provided in the leading edge of the recording member 12 to receive at least a portion of the locating pins 56. This helps to properly position the recording medium 12 laterally relative to the clamp assembly 14.

Following this, the cam member 36 is turned clockwise as viewed in FIGS. 3 and 4 to its closed or clamping position illustrated in FIG. 4 so that the stop pin 52 engages notch wall 54 and the raised camming surface area 36*b* top plate 42 upward as shown in that figure. That raised surface forces the interposer portion 62*b* toward top plate 42 thereby clamping the leading edge margin of the recording medium 12 between the interposer portion 62*b* and the top plate.

Because of the presence of the interposer, the rotary motion of the cam member to its clamping position does not exert any pulling force or drag on the recording medium that might upset the medium leading edge registration.

To release the recording medium 12 from the head clamp assembly 14, the cam member 36 is rotated in the opposite or counterclockwise direction as viewed in FIGS. 3 and 4 until the pin 52 engages the top edge of the channel wall 34*a* as shown in FIG. 3. At that point, the cam member flat sector 36*a* which now faces top plate 42 relieves the upward force on the interposer portion 62*b* thereby allowing the recording medium to be withdrawn from the space between the interposer 62 and the top plate 42.

Figure 5:
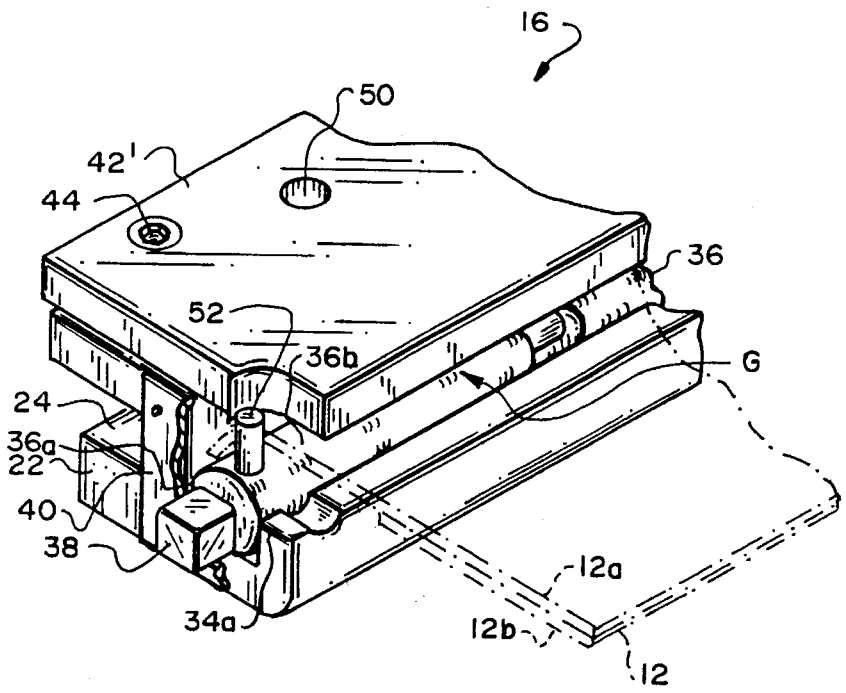
FIG. 5 is a view similar to FIG. 4 showing in greater detail the tail clamp assembly on the FIG. 1 cylinder, the assembly being in its clamping position.

Refer now to FIG. 5 which shows the tail clamp assembly 16 in greater detail. For the most part, assembly 16 is the same as assembly 14. Accordingly, its component parts are identified by the same numerals as the corresponding parts in assembly 14. Assembly 16 differs from assembly 14 only in that it lacks the interposer 62 and it has a top plate 42' which is devoid of the locating pins 56 present in the top plate 42 of assembly 14. The clamp assembly 16 functions like assembly 14 to clamp the tail end of the recording medium 12 to cylinder 10. In addition, however, assembly 16 draws the recording medium 12 tightly about cylinder 10 by applying tension to the tail end of the medium at the same time that it grips that end of the medium.

More particularly, when the cam member 36 of clamp assembly 16 is in its open or unclamping position wherein the stop pin 52 engages the channel wall 34*a* and the cam member flat sector 36*a* faces 15 plate 42', the tail end margin of the recording medium 12 may be slid into the gap G between the cam member and the top plate 42'. Since assembly 16 does not include the interposer 62 present in assembly 14, the cam member 36 directly engages the underside of the recording medium 12. Accordingly, when the cam member 36 is rotated counterclockwise as viewed in FIG. 5 to its closed or clamping position illustrated in that figure, the raised camming surface area 36*b* of the cam member is rotated into engagement with the recording medium and squeezes the recording medium between the cam member and the top plate 42'. This direct contact also causes the recording medium to move with the cam member so that the tail end portion of the medium is drawn into the channel 34 of clamp assembly 16 to some extent. Resultantly, while being clamped by assembly 16, the recording medium is also tensioned or stretched causing it to tightly hug the surface of the cylinder 10 all around the cylinder.

If the recording medium 12 is a plural sheet set as specifically illustrated herein, only the donor sheet 12*b* needs to be clamped and tensioned by the tail clamp assembly 16 as shown in FIG. 5 because the acceptor sheet 12*a* will automatically be held in place on the cylinder 10 by the overlying tensioned donor sheet. This plate configuration produces an added advantage in that the acceptor sheet 12*a* which is the actual plate may vary in length to accommodate different size presses while the length of the donor sheet 12*b* is held constant. It also allows the clamp assemblies 14 and 16 to be in fixed positions on cylinder 10 while clamping to the cylinder acceptor sheets or plates of various lengths.

It is apparent from the foregoing that our clamp assembly is quite versatile in that with minor modification, the same clamp assembly can be used either as a head clamp or a tail clamp. Furthermore, the clamp assembly can clamp or fixate a variety of different types of lithographic plates and other flexible sheet-like recording media. With a single rotation of the cam member, the assembly can grip and may also stretch such recording media about a cylinder. Yet, the clamp assembly is still relatively easy and inexpensive to make and to assemble. It comprises only a few relatively simple machined parts which may be assembled by hand using simple tools. For example, the cam member 36 may simply be dropped into place in the channel 34 of block 22 and the top plate 42 or 42' attached to the block 22 by screws 44. If the assembly includes the interposer 62, that is simply positioned on block 22 prior to installing the top plate.

It will thus be seen that the objects set forth above, among those made apparent from the preceding description, are efficiently attained. Also, certain changes may be made in the above construction without departing from the scope of the invention. For example, the registration pins 56 may be threaded into appropriate holes in the top plate so that their ends extend below the plate. In that way, the same top plate can be used for both the head and tail clamp assemblies 14 and 16. Accordingly, it is intended that all matter contained in the above description or shown in the accompanying drawings be interpreted as illustrative and not in a limiting sense.

It is also to be understood that the following claims are intended to cover all of the generic and specific features of the invention described herein.

What is claimed is:

1. A clamp assembly for clamping a flexible sheet-like recording medium to a cylinder, said assembly comprising a base defining an elongated channel;

a plate mounted to the base and overlying the channel;

an elongated rigid cam member rotatably positioned in said channel, said cam member having a cam surface profiled so that when the cam member is in a first rotary position in the channel, the cam surface extends relatively close to said plate and when the cam member is in a second rotary position in the channel, the cam surface is spaced further away from said plate, and stop means for establishing said first and second positions of the cam member so that when the cam member is in said second position and an edge margin of a recording medium is inserted between the cam member and the plate, moving the cam member to said first position causes the cam member to simultaneously grip and pull the recording medium toward said channel, said stop means including a projection on the cam member which engages said plate when the cam member is in said first position and which engages said base when the cam member is in said second position.

2. The clamp assembly defined in claim 1 and further including means on the cam member to facilitate moving the cam member between said first and second positions.

3. The clamp assembly defined in claim 1 wherein said cam surface includes a fiat sector which extends the length of the cam member.

4. The clamp assembly defined in claim 1 wherein at least one of said plate and a portion of said base is compliant to facilitate control over the gripping force exerted on the recording medium by the clamp assembly.

5. A clamp assembly for clamping a flexible sheet-like recording medium to a cylinder, said assembly comprising a base defining an elongated channel;

a plate mounted to the base and overlying the channel;

an elongated rigid cam member rotatably positioned in said channel, said cam member having a cam surface profiled so that when the cam member is in a first rotary position in the channel, the cam surface extends relatively close to said plate and when the cam member is in a second rotary position in the channel, the cam surface is spaced further away from said plate;

stop means for establishing said first and second positions of the said cam member so that when the cam member is in said second position and an edge margin of a recording medium is inserted between the cam member and the plate, moving the cam member to said first position, clamps the recording medium edge margin between the cam member and the plate, and cantilevered interposer means having a stationary one end and positioned between the plate and the cam member for preventing the cam member from directly contacting said edge margin of the recording medium when the cam member is moved to said first position thereby preventing the pulling of said recording medium by the cam member when said edge margin is clamped.

6. The clamp assembly defined in claim 5 wherein the interposer means comprises a flat, flexible plate which is cantilivered opposite said cam member along substantially the entire length of the cam member.

7. The clamp assembly in claim 5 and further including a plurality of recording medium locating means extending from said plate toward said base and disposed along a line extending substantially parallel to said cam member.

8. The clamp assembly defined in claim 7 wherein said locating means comprise registration pins which extend though said interposer means.

9. In a rotary cylinder, a clamp assembly comprising a head clamp for clamping the leading edge margin of a recording medium to the cylinder;

a tail clamp for clamping the trailing edge margin of a recording medium to the cylinder, said clamps being mounted to said cylinder close to and substantially parallel to one another, each clamp including a base defining a channel extending substantially the entire length of the cylinder, a plate mounted to said base opposite said channel, a rigid cam member rotatably positioned in said channel and having a cam surface spaced from said plate to defined a gap, said cam member being movable between a clamping position wherein said cam surface is located relatively close to said plate and an open position wherein said cam surface is further away from said plate;

means for moving the cam member between said open and clamping positions, and wherein said head clamp also includes a plurality of locating pins extending from the plate toward the base of said head clamp for locating the leading edge of a recording medium introduced into said gap of said head clamp, and interposer means positioned between the plate and cam member of said head clamp for preventing the cam member of said head clamp from directly engaging the leading edge margin of a recording medium introduced into said gap of said head clamp.

10. The clamp assembly defined in claim 9 wherein said interposer means comprise a leaf spring which is cantilevered opposite, and extends substantially the entire length of, the associated cam member.

11. The clamp assembly defined in claim 10 wherein said leaf spring includes a plurality of openings for receiving said plurality of locating pins.

12. The clamp assembly defined in claim 9 and further including a recording medium wrapped about said cylinder, said recording medium having end portions extending into said gaps of said head and tail clamps.

13. The clamp assembly defined in claim 12 wherein the recording medium is a lithographic plate.

14. The clamp assembly defined in claim 12 wherein said recording medium comprises an acceptor sheet wrapped around the cylinder and a donor sheet wrapped around the acceptor sheet, and only the doner sheet extends into said gap of said tail clamp.

* * * * *